US006126478A

United States Patent [19]

Presson et al.

[11] Patent Number: 6,126,478

[45] Date of Patent: Oct. 3, 2000

[54] WIRING DEVICE WITH GRIPPING OF INDIVIDUAL CONDUCTORS

[75] Inventors: Jerry M. Presson, Trumbull; Willaim C. Boteler, Bridgeport, both of Conn.

[73] Assignee: Hubbell Incorporated, Orange, Conn.

[21] Appl. No.: 09/108,295

[22] Filed: Jul. 1, 1998

[51] Int. Cl.[7] ..... H01R 13/58

[52] U.S. Cl. ..... 439/467; 439/595

[58] Field of Search ..... 439/467, 595, 439/596, 686, 693, 703

[56] References Cited

U.S. PATENT DOCUMENTS

| | | | |
|---|---|---|---|
| 3,393,395 | 7/1968 | Hubbell . | |
| 3,437,980 | 4/1969 | Smith . | |
| 3,784,961 | 1/1974 | Gartland, Jr. . | |
| 3,856,376 | 12/1974 | Poliak et al. . | |
| 3,904,265 | 9/1975 | Hollyday et al. . | |
| 4,080,036 | 3/1978 | Hagel . | |
| 4,108,527 | 8/1978 | Douty et al. . | |
| 4,138,185 | 2/1979 | Jaconette, Jr. . | |
| 4,178,056 | 12/1979 | Lee . | |
| 4,208,085 | 6/1980 | Lawrence et al. . | |
| 4,213,667 | 7/1980 | Wittes . | |
| 4,561,715 | 12/1985 | Sanchez . | |
| 4,721,483 | 1/1988 | Dickie . | |
| 4,722,580 | 2/1988 | Kocher et al. . | |
| 4,749,369 | 6/1988 | Wang . | |
| 4,921,441 | 5/1990 | Sauder . | |
| 4,931,023 | 6/1990 | Browne | 439/459 |
| 4,963,104 | 10/1990 | Dickie | 439/460 |
| 5,217,389 | 6/1993 | MacKay et al. | 439/466 |
| 5,277,619 | 1/1994 | Yamamoto | 439/469 |
| 5,295,857 | 3/1994 | Toly | 439/395 |
| 5,304,075 | 4/1994 | Hoffman | 439/472 |
| 5,338,222 | 8/1994 | Boteler | 439/469 |
| 5,588,870 | 12/1996 | Boteler et al. | 439/467 |
| 5,591,046 | 1/1997 | Klein et al. | 439/467 |
| 5,873,748 | 2/1999 | Getselis et al. . | |
| 5,885,099 | 3/1999 | Sandor | 439/467 |

*Primary Examiner*—Lincoln Donovan
*Attorney, Agent, or Firm*—Alfred N. Goodman; Robert S. Green

[57] ABSTRACT

An electrical wiring device having strain relief assemblies for gripping an electrical cord and the individual conductors extending from the end of the cord. The electrical wiring device has a set of gripping members for providing strain relief between the electrical conductors of the electrical cord and the terminals of the electrical device. The electrical wiring device also includes a pair of housing halves which support an additional set of gripping members for engaging the electrical cord upon installation therein. The housing halves also support the set of gripping members for the conductors.

51 Claims, 7 Drawing Sheets

FIG. 4
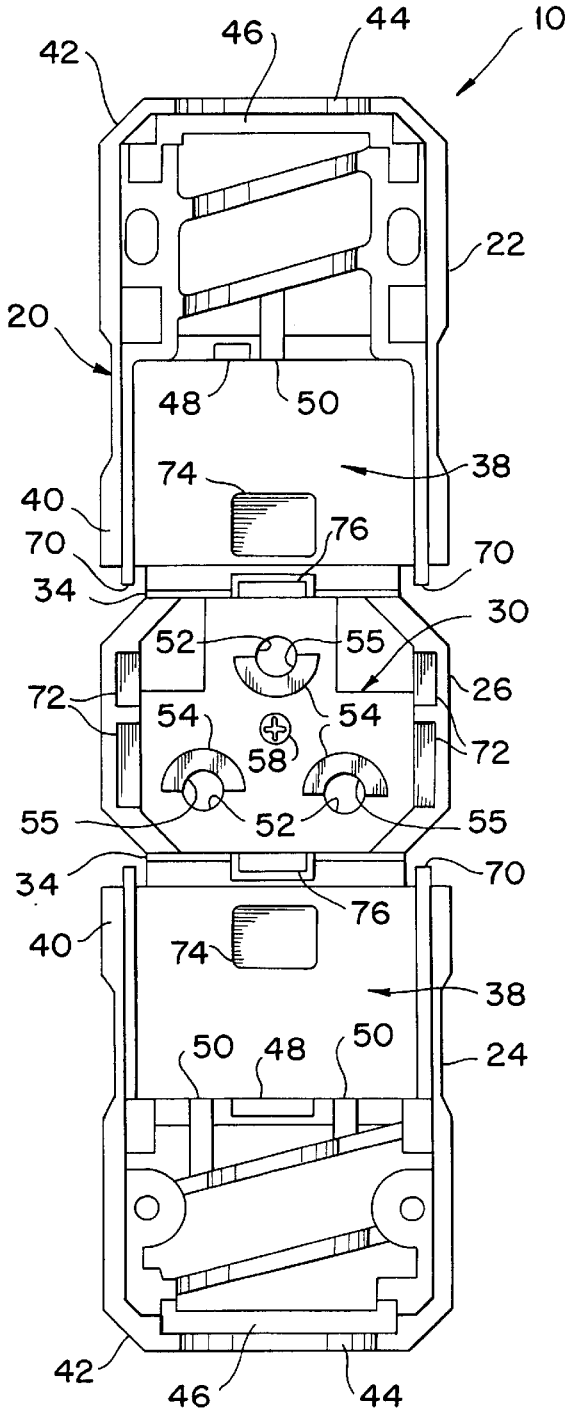
FIG. 5
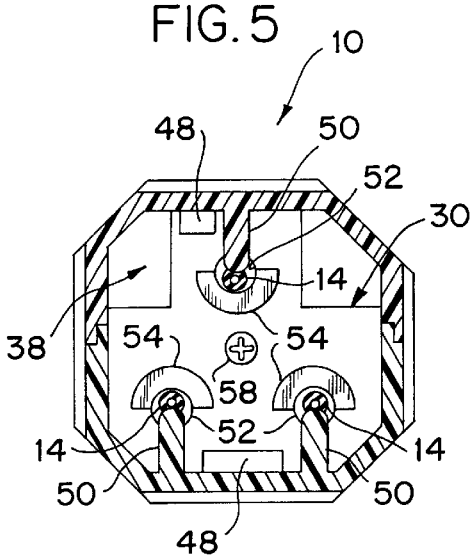
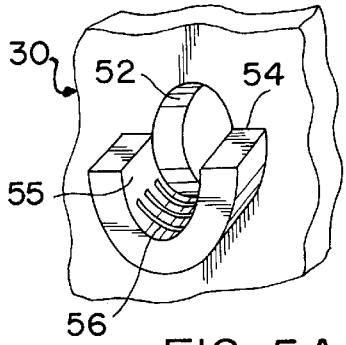
FIG. 5A
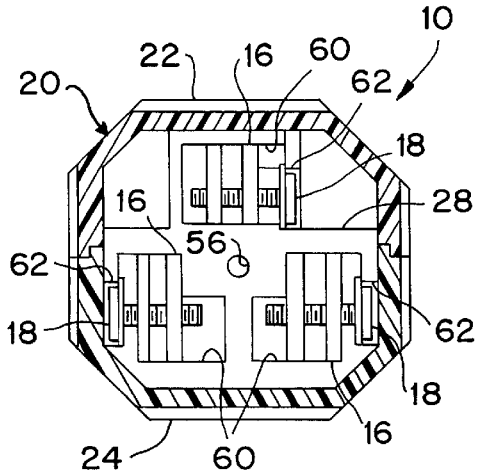
FIG. 6

WIRING DEVICE WITH GRIPPING OF INDIVIDUAL CONDUCTORS

FIELD OF THE INVENTION

This invention relates to an electrical wiring device provided with strain relief between the end of the electrical cord and the terminals of the electrical device. More specifically, the present invention relates to an electrical wiring device with a first set of gripping members for individually gripping the electrical conductors of the cord to provide strain relief between the electrical conductors and the terminals of the electrical device, and a second set of gripping members for gripping the electrical cord to provide a similar strain relief.

BACKGROUND OF THE INVENTION

Electrical devices such as electrical connectors typically have an electrical cord or cable extending outwardly from the device. It is necessary to securely fasten the electrical cord to the electrical device to prevent the electrical conductors from being pulled from their terminations, which can damage the conductors and the electrical device. If the electrical conductors are pulled or torn away from their terminations in the electrical device, this can result in the electrical device becoming inoperable, and in certain circumstances can result in serious injury to the user due to shorting of the electrical current being carried in the conductors.

Accordingly, corded electrical devices typically include a strain relief assembly for gripping and coupling the electrical cord or cable thereto, and for maintaining slack between the ends of the conductors and their respective terminals or electrical connections within the electrical device. Presently, there are a wide variety of strain relief assemblies available for electrical devices. For example, many electrical devices have a pair of cord clamping members for gripping and coupling the electrical cord thereto. Typically, one of the cord clamping members is stationary, while the other cord clamping member is movable in a direction substantially perpendicular to the longitudinal axis of the electrical cord. The clamping members may include a rib or a series of ribs for engaging the electrical cord to ensure a good grip on the electrical cord.

Examples of some prior electrical connectors having a strain relief assembly with a stationary clamp and a movable clamp are disclosed in the following U.S. Pat. Nos.: 3,393,395 to Hubbell; 3,784,961 to Gartland, Jr.; 3,904,265 to Hollydale et al; 4,080,036 to Hagel; 4,178,056 to Lee; 4,213,667 to Wittes; 4,931,023 to Browne; 5,217,389 to MacKay et al; 5,304,075 to Hoffman; and 5,338,222 to Boteler.

Examples of some other prior electrical connectors with internal strain relief are disclosed in the following U.S. Pat. Nos.: 3,437,980 to Smith; 3,856,376 to Poliak et al; 4,108,527 to Douty et al; 4,138,185 to Jaconette, Jr.; 4,208,085 to Lawrence et al; 4,561,715 to Sanchez; 4,721,483 to Dickie; 4,722,580 to Kocher et al; 4,749,369 to Wang; 4,921,441 to Sauder; 4,963,104 to Dickie; and 5,277,619 to Yamamoto.

One disadvantage with these prior art strain relief assemblies is that the electrical conductors of the electrical cord are gripped as a group. In other words, the clamping elements of the strain relief assembly directly engages the outer sheath of the electrical cord with the conductors bundled therein. The problem with gripping the sheath of the cord is that the sheath is typically constructed of a stretchable material. When an axial force is applied to the cord, the sheath can stretch and the conductors therein will slide beneath the sheath at the point of the clamping elements. If such sliding movement of the conductors occurs, then the ends of the terminals may pull out of their terminal connections.

In addition, some of the prior art strain relief assemblies increase the difficulty of assembling the electrical connectors. Moreover, some of these strain relief assemblies are difficult to manufacture and require special molding procedures which can significantly increase the total cost of the electrical connectors.

In view of the above, it is apparent that there exists a need for an electrical cord clamp for an electrical device or connector which will overcome the above-mentioned problems of the prior art devices. This invention addresses this need in the art along with other needs which will become apparent to those skilled in the art once given this disclosure.

SUMMARY OF THE INVENTION

One object of the present invention is to provide an electrical device with a strain relief cord clamp which is relatively quick and easy to assemble about an electrical cord.

Another object of the present invention is to provide an electrical device with gripping members which engages the individual conductor adjacent the terminals for providing strain relief between the ends of the electrical conductors and the terminals of the electrical device.

Another object of the present invention is to provide a first set of gripping members to grip the individual conductors and a second set of gripping members to grip the electrical cord containing the conductors.

Still another object of the present invention is to provide a cord clamp for an electrical device which can be economically manufactured.

The foregoing objects are basically attained by an electrical connector adapted to be coupled to an end of an electrical cord with a plurality of electrical conductors, comprising a contact retainer portion having at least two blade contacts with at least two terminals therein, a front end adapted to mate with a mating electrical wiring device, and an inner end adapted to receive the electrical conductors of the electrical cord; a first cover portion having a first end coupled to the contact retainer portion, a second end spaced from the first end, and a first cavity formed between the first and second ends; a second cover portion having a first end coupled to the contact retainer portion, a second end spaced from the first end of the second cover portion, and a second cavity formed between the first and second ends of the second cover portion; a first gripping member coupled to at least one of the portions adjacent the inner end of the contact retainer portion to engage and grip the electrical conductors of the electrical cord; and a second gripping member coupled to at least one of the portions adjacent the inner end of the contact retainer portion to engage and grip the electrical conductors of the electrical cord between the first and second gripping members.

Other objects, advantages and salient features of the present invention will become apparent to those skilled in the art from the following detailed description, which taken in conjunction with the annexed drawings, discloses preferred embodiments of the present invention.

BRIEF DESCRIPTION OF THE DRAWINGS

Referring now to the attached drawings which form part of this original disclosure:

FIG. 4 is an inside elevational view of the electrical connector illustrated in FIGS. 1–3 in its fully open condition as seen in FIG. 3, and with the electrical conductors of the electrical cord removed for purposes of illustration;

FIG. 5 is a transverse cross-sectional view of the electrical connector illustrated in FIGS. 1–4 as seen along section line 5—5 of FIG. 2, with the housing in the fully closed position;

FIG. 5A is a partial enlarged perspective view of a portion of the internal cap with one of the gripping members or abutments integral coupled thereto;

FIG. 6 is a transverse cross-sectional view of the electrical connector illustrated in FIGS. 1–5 as seen along section line 6—6 of FIG. 2, with the housing fully closed so that the gripping members restrain the electrical conductors of the electrical cord relative to the terminals of the contact retainer body;

DETAILED DESCRIPTION OF THE PREFERRED EMBODIMENTS

Figure 1:
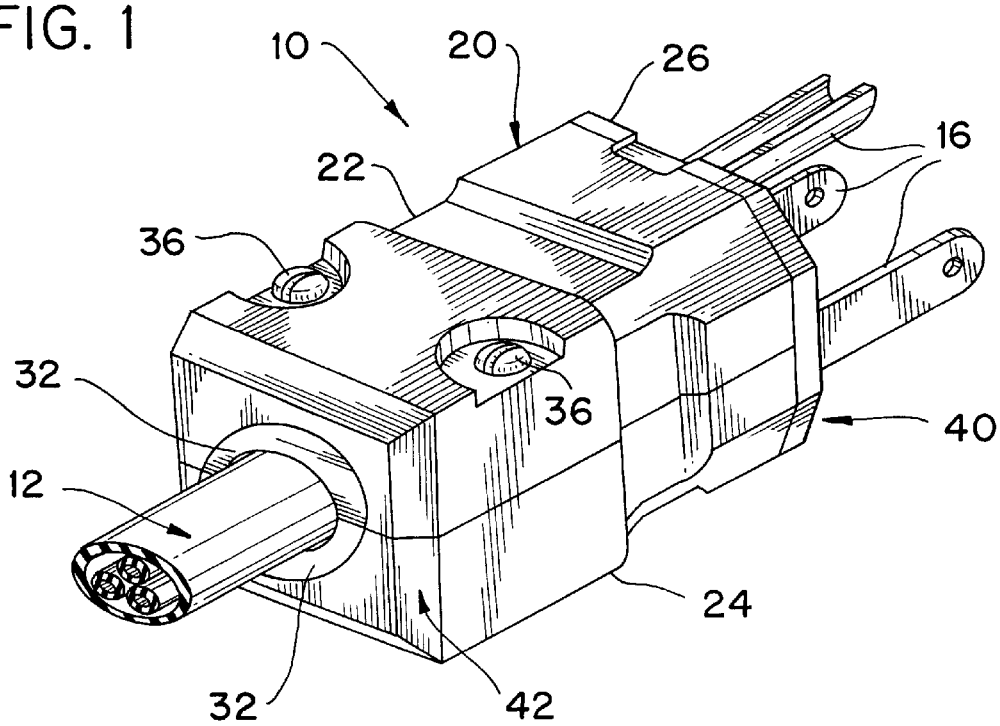
FIG. 1 is a rear end perspective view of an electrical wiring device in the form of a male electrical connector or plug coupled to an electrical cord in accordance with a first embodiment of the present invention.
Figure 2:
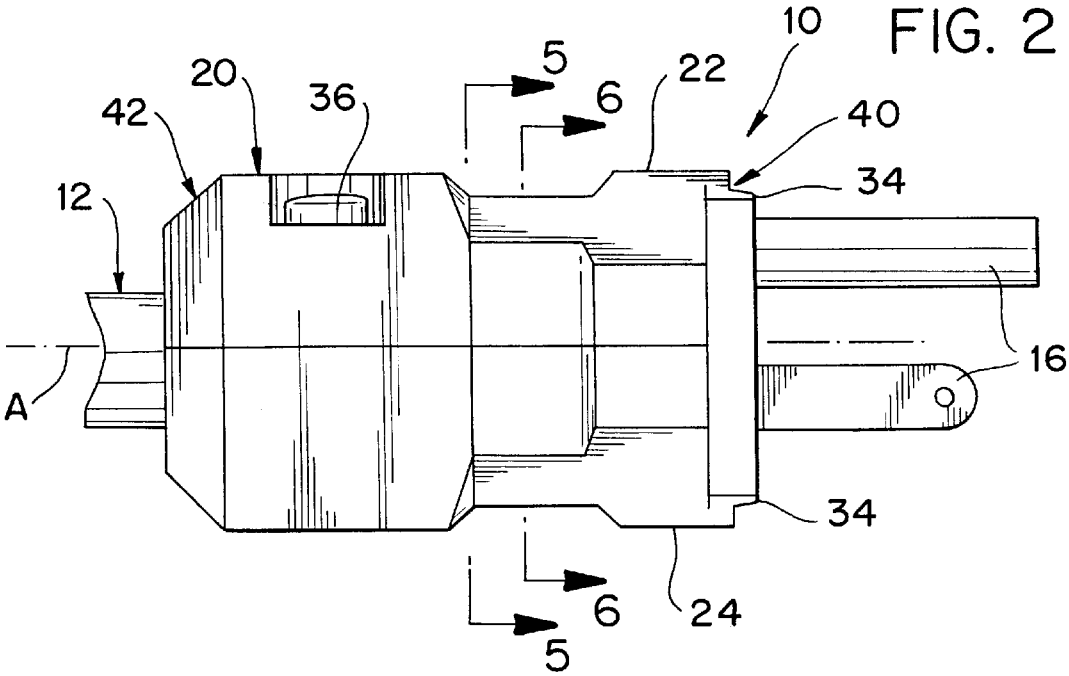
FIG. 2 is a side elevational view of the electrical connector and electrical cord illustrated in FIG. 1.
Figure 3:
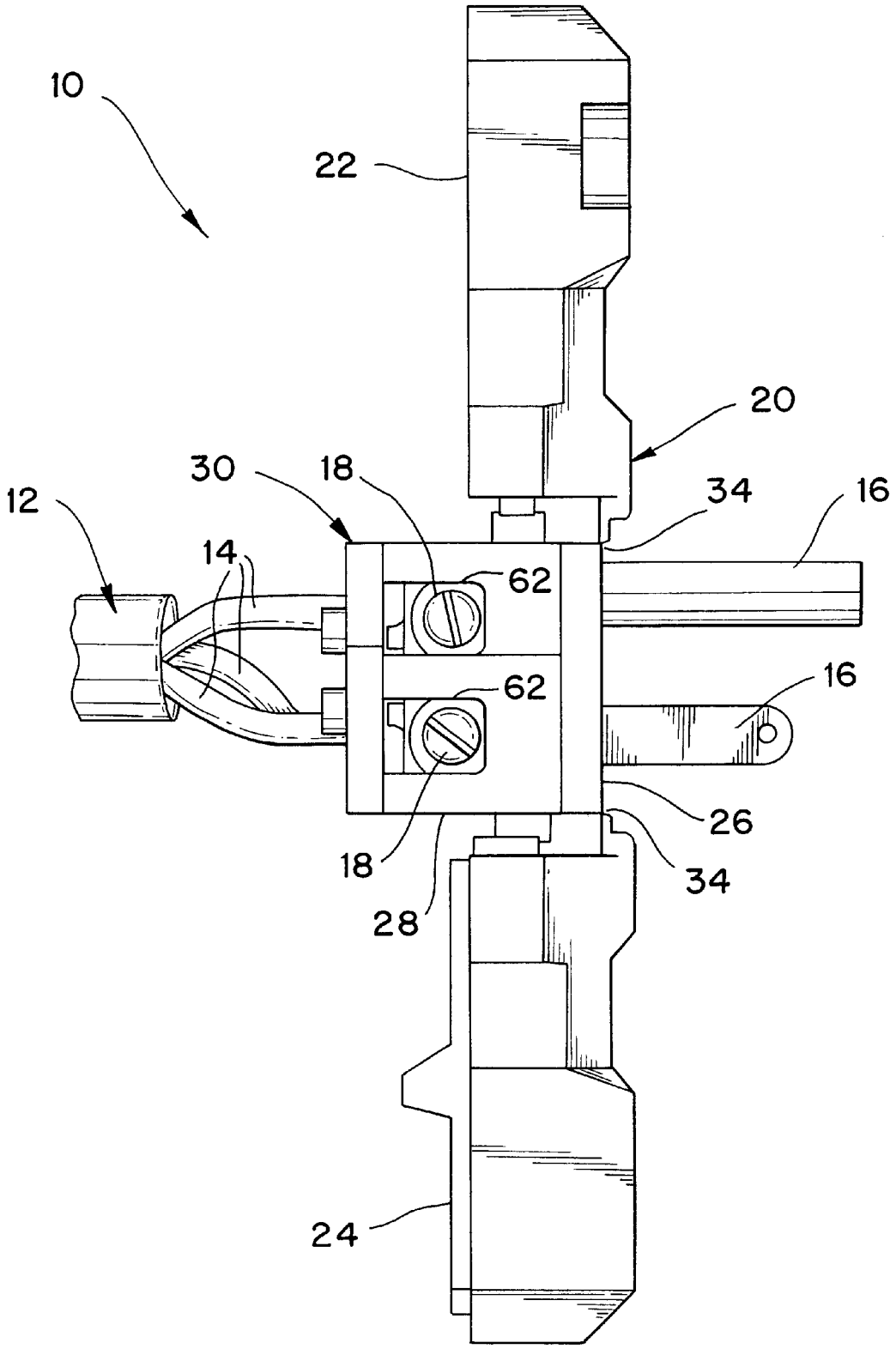
FIG. 3 is a side elevational view of the electrical connector illustrated in FIGS. 1 and 2 in its open condition and with the electrical cord, the internal cap and the terminals coupled thereto.
Figure 7:
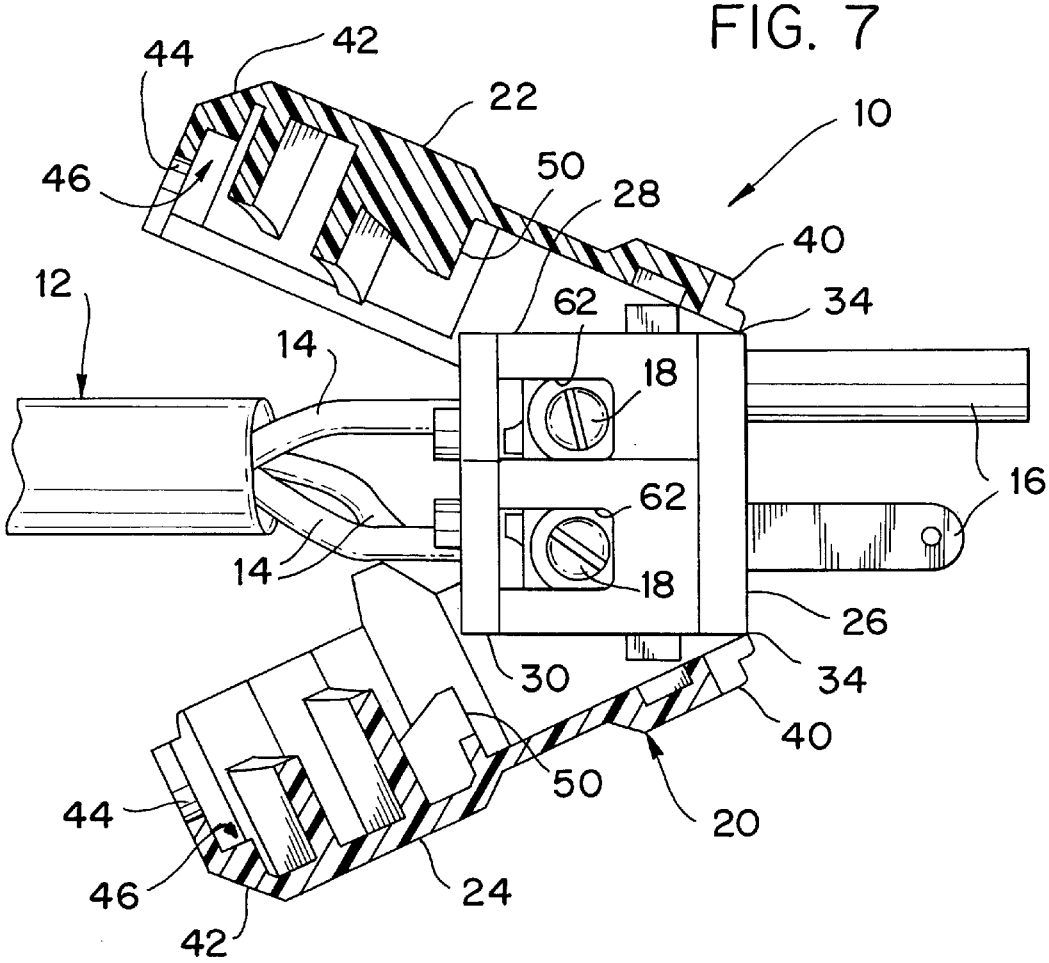
FIG. 7 is a longitudinal cross-sectional view of the electrical connector illustrated in FIGS. 1–6, with the housing partially closed, i.e., prior to the gripping members engaging the electrical conductors of the electrical cord.

Referring initially to FIGS. 1–3, an electrical wiring device or connector 10 with a strain relief arrangement is illustrated in accordance with a first embodiment of the present invention. Specifically, as explained below in more detail, electrical connector 10 clamps both the free end of electrical cord 12 (FIGS. 1 and 8) as well as the individual conductors 14 of cord 12 (FIGS. 5 and 8) to prevent cord 12 from being pulled out of electrical connector 10. It will be apparent to those skilled in the art from this disclosure that this embodiment and the other embodiments disclosed herein are only examples of preferred embodiments of the present invention, and thus, these examples should not be taken as limiting the scope of the present invention.

Figure 13:
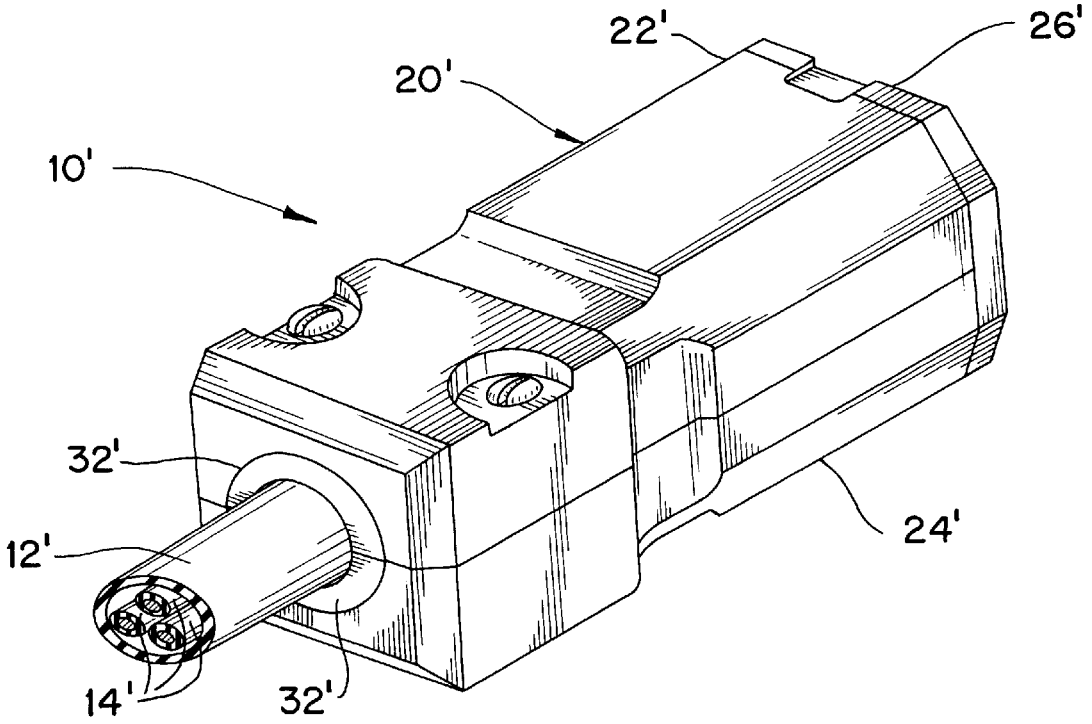
FIG. 13 is a perspective view of an electrical wiring device in the form of a female electrical connector coupled to an electrical cord in accordance with a fourth, embodiment of the present invention.
Figure 14:
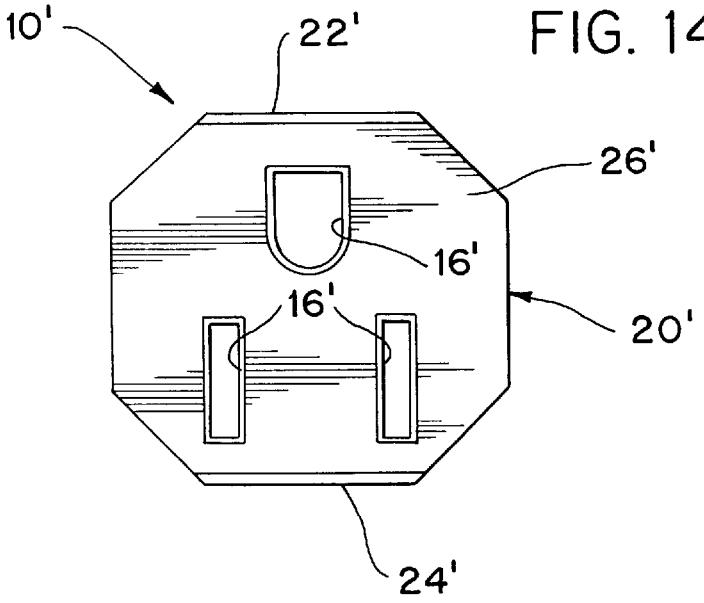
FIG. 14 is a front end elevational view of the female electrical connector in accordance with the fourth embodiment of the present invention.

For example, while electrical connector 10 in this first embodiment is illustrated as a plug or a male electrical connector attached to one end of electrical cord 12, it will be apparent to those skilled in the art from this disclosure that electrical wiring device 10 can be a female electrical connector (as seen in FIGS. 13 and 14), or can be part of an electrical wiring device or part of a device such as an appliance or tool.

As seen in FIG. 1, electrical cord 12 is a conventional electrical cord, and this, will not be discussed in detail. By way of example, electrical cord 12, as seen in the drawings, preferably has three electrical conductors 14 with each of the conductors 14 having an electrical conductive core and an insulating sheath thereon. In this type of electrical connector 10, the electrical conductors 14 typically have a plurality of strands forming the conductive core. The ends of the electrical conductors 14 are stripped and attached to the three electrical contacts 16 of electrical connector 10. While three conductors 14 are illustrated in this first embodiment, it will be apparent to those skilled in the art from this disclosure that the present invention can be utilized, with electrical cords having only two electrical conductors or with electrical cords having more than three electrical conductors.

As seen in FIGS. 1–3, electrical contacts 16 of this first embodiment are preferably conventional male blade contacts with terminal screws 18 (only two shown) for securing the stripped end of electrical conductors 14 thereto. Accordingly, electrical contacts 16 will not be discussed or illustrated in detail herein.

Figure 8:
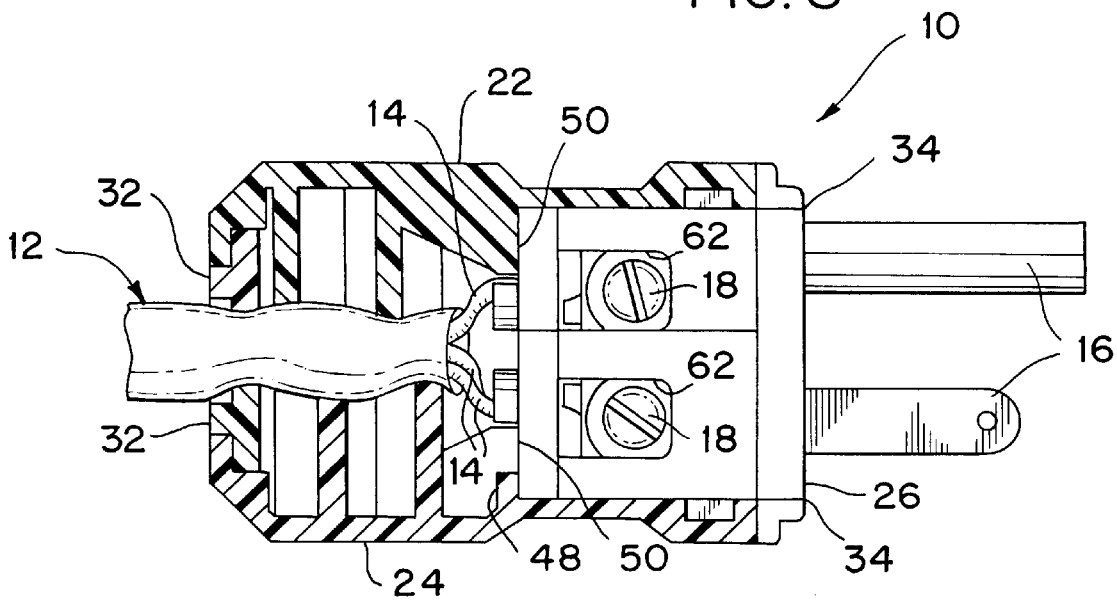
FIG. 8 is a longitudinal cross-sectional view of the electrical connector illustrated in FIGS. 1–7, with the housing fully closed so that the gripping members restrain the electrical conductors of the electrical cord relative to the terminals located in the contact retainer body.

As best seen in FIGS. 3 and 4, electrical connector 10 has a housing 20 with a first cover half 22, a second cover half 24, a front cover face 26 with a contact retainer body, or portion 28 coupled thereto and an internal cap 30. Electrical connector 10 also has a pair of clamping members 32 as seen in FIGS. 1 and 8, which form a cord clamp to provide strain relief between the end of electrical cord 12 and electrical connector 10 and terminals 16. Clamping members 32 can be constructed in accordance with U.S. Pat. No. 4,138,185 to Jaconette, Jr. or in accordance with U.S. Pat. No. 5,591,046 to Klein et al.

Basically, electrical connector housing 20 is a modified version of the electrical connector housings illustrated and disclosed in U.S. Pat. No. 4,010,999 to Hoffman and U.S. Pat. No. 4,138,185 to Jaconette, Jr. in that housing 20 has a unique strain relief arrangement. The disclosure of these two U.S. patents are hereby incorporated herein by reference. Accordingly, electrical connector housing 20 will only be discussed herein as necessary to understand the present invention.

Preferably, cover halves 22 and 24, front cover face 26 and contact retainer body 28 are all integrally formed as a one-piece, unitary unit of a suitable insulating material such as nylon. More specifically, first cover half 22 and second cover half 24 are hinged to front cover face 26 by web or living hinges 34, while contact retainer body 28 is integrally formed with front cover face 26. Contact retainer body 28 extends from the interior surface of front cover face 26 between cover halves 22 and 24 to a free inner end which in turn has internal cap 30 coupled thereto.

As seen in FIGS. 1 and 2, electrical connector housing 20 is held in its assembled position by a pair of screws 36 in a conventional manner. Of course, other types of fastening members can be used to hold cover halves 22 and 24 together. For example, U.S. Pat. Nos. 4,108,527 to Douty et al and 5,217,389 to MacKay et al. disclose electrical connectors which have their cover halves coupled together using fasteners other than screws. Accordingly, such fasteners could be utilized to connect first cover half 22 and second cover half 24 together if needed and/or desired.

Cover halves 22 and 24 are substantially identical for purposes of discussion of this invention. Of course, as seen in the Figures, there are some minor differences between cover halves 22 and 24 for mating of cover halves 22 and 24 together during assembly thereof. Accordingly, like reference numerals will be utilized to discuss the parts which are common between cover halves 22 and 24.

As seen in FIGS. 4–6, cover halves 22 and 24 have a generally U-shaped transverse cross-sections to form a cord receiving cavity 38 for receiving the free end of electrical cord 12, contact retainer body 28 and internal cap 30 therein. More specifically, each of the cover halves 22 and 24 have a first or open end 40 coupled to front cover face 26 by web hinges 34. The second or closed ends 42 of each of the cover halves 22 and 24 have a semi-circular cord opening 44 for receiving electrical cord 12 therein. A recess 46 is formed adjacent cord opening 44 of each cover half for frictionally retaining one of the clamping members 32 therein. The first and second ends 40 and 42 also form the opposite ends of the housing 20 along the longitudinal axis A of the housing 20 as seen in FIG. 2.

As seen in FIGS. 4 and 5, each of the cover halves 22 and 24 further includes a retaining flange or member 48 for engaging and retaining internal cap 30 against the inner free end of contact retainer body 28, and one or more gripping members or abutments 50 for individually engaging and clamping conductors 14 against abutments 34 of internal cap 30 as discussed below. Accordingly, when electrical cord connector 10 is assembled, each of the electrical conductors 14 of electrical cord 12 are attached to one of the contacts 16 and clamped between gripping members 50 and internal cap 30. The end of the electrical cord 12 is also substantially simultaneously clamped between cord clamps 32 to retain electrical cord 12 therein as cover halves 22 and 24 are closed. Thus, cord clamps 32 form a first set of gripping members that frictionally engage cord 12 adjacent end 42 of housing 20, and gripping members 50 and internal cap 30 form a second set of gripping members that frictionally engage the conductors 14 between ends 40 and 42 of housing 20.

Internal cap 30 is at least partially prevented from disengaging from contact retainer body 28 by retaining members 48 which engage the upper and lower edges of internal cap 30 to prevent separation of internal cap 30 from contact retainer body 28. More specifically, internal cap 30 is sandwiched between retaining members 48 and contact retainer body 28, when electrical connector 10 is in the closed position as seen in FIG. 8. In addition, gripping members 50 of cover halves 22 and 24 also engage internal cap 30 to prevent movement of internal cap 30 and contacts 16. Accordingly, retaining members 48 can be eliminated by making gripping members 50 with sufficient strength to retain internal cap 30 against contact retainer body 28.

Internal cap 30 guides electrical connectors 14 within housing 20 to terminal 18 of contacts 16 and prevents contacts 16 from moving within housing 20. After electrical connector 10 is fully assembled, internal cap 30 retains contacts 16 in place to prevent contacts 16 from moving within housing 20. More specifically, as best seen in FIG. 4, internal cap 30 is basically a T-shaped member with three wire openings 52 extending therethrough, and three abutments or complementary gripping members 54 extending outwardly from a first side of internal cap 30. The other side of internal cap 30 can be shaped for engaging contacts 16.

When electrical connector 10 is in its closed position as seen in FIGS. 5 and 8, gripping members 54 of internal cap 30 cooperate with gripping members 50 of cover halves 20 and 22 to squeeze electrical conductors 14 therebetween. In other words, gripping members 50 and 54 are substantially aligned and spaced apart from each other such that the space located therebetween is slightly smaller than the outer diameter or width of electrical conductors 14 to grip conductors 14 for restraining them from moving within housing 12. Thus, each individual conductor 14 is independently restrained from movement to prevent accidental separation of the free ends of conductors 14 from terminals 18.

Preferably, gripping members 54 are integrally formed with internal cap 30. Internal cap 30 is preferably constructed of an insulating material such as plastic. For example, internal cap 30 can be constructed as a one-piece, unitary member which is molded out of a plastic material such as nylon. However, as seen in the later embodiments, gripping members 54 can be either separate elements and/or integrally formed with one of the cover halves 22 or 24. Preferably, gripping members 54 are semi-circular abutments which are integrally formed adjacent the conductor holes of internal cap 30. As best seen in FIG. 5A, each of the gripping members 54 has a semi-circular inner surface 55 which partially surrounds conductor holes 52 of internal cap 30. While gripping members 54 are illustrated as arc-shaped members, it will be apparent to those skilled in the art from this disclosure that a variety of configurations can be utilized for gripping members 54. For example, gripping members 54 can be substantially V-shaped members. Preferably, the semi-circular inner surfaces 55 of gripping members 54 have ridges 56 to prevent longitudinal movement of the conductors 14 when the conductors 14 are gripped between the gripping members or abutments 50 and 54. Of course, the ridges 56 on the semi-circular inner surfaces 55 of gripping members 54 could be replaced with other type of gripping means that prevents longitudinal movement of the conductors 14.

As seen in FIGS. 4–6, a screw 58 extends through a center opening 66 in the center of internal cap 30 for securing internal cap 30 to contact retainer body 28. Alternatively, internal cap 30 can be secured to contact retainer body 28 via a snap-fit connection as disclosed in U.S. Pat. No. 5,645,447 to Sandor. The entire disclosure of U.S. Pat. No. 5,645,447 is hereby incorporated herein by reference.

Wire openings 52 are arranged with one of the wire openings 52 in communication with one of the contacts 16 such that one of the electrical conductors 14 extends through each of the openings 52 in cap 30 for attachment to its respective terminal screw 18. Wire openings 52 are also positioned sufficiently far apart to keep electrical conductors 14 separate as they exit out of the sheath of electrical cord 12 to prevent electrical current from arcing between conductors 14.

As best seen in FIG. 6, contact retainer body 28 has three longitudinally extending contact cavities 60 extending substantially perpendicular to front cover face 26 for receiving contacts 16 therein. More specifically, each contact cavity 60 has a free end separate from front cover face 26 which engages internal cap 30, while the other end is fixed to front cover face 26 adjacent one of the contact openings. In the case of a male connector, as seen in FIGS. 1–8, contacts 16 extend through the contact openings in front cover face 26 to form three exposed blades which can be inserted into a mating female connector. Accordingly, contacts 16 are restrained from longitudinal movement within cavities 60 by internal cap 30 and front cover face 26.

Preferably, contacts 16 are inserted into the open ends of cavities 60 and then press-fitted or frictionally retained into cavities 60 such that a portion of contacts 16 extend outwardly from front cover face 26 via the contact openings. By using a press-fit arrangement, contacts 16 will not fall out of cavities 60 before internal cap 30 is coupled to contact retainer body 28. Of course, internal cap 30 ensures that contacts 16 cannot move even when a force is applied to cord 12. Alternatively, contacts 16 may include barbs for engaging the interior surfaces of contact cavities 60 to more securely retain contacts 16 therein during assembly.

Contact retainer body 28 also has three access openings 62 (only two seen in FIGS. 3, 7 and 8) with one of the access openings 62 extending into one of the contact cavities 60. Access openings 62 allow a user to insert a screwdriver or the like therethrough such that the respective terminal screw 18 can be tightened down upon the corresponding conductor 14 for securely attaching the conductor to the contact.

As seen in FIG. 6, contact retainer body 28 also includes a centrally located opening in the form of a socket or bore 66 for threadedly receiving screw 58 to fasten internal cap 30 thereto. Alternatively, internal cap 30 can be releasably retained to contact retainer body 28 by a tight-fit which is defined herein as including a snap-fit, a press-fit, a friction-fit or the like. In either case, internal cap 30 will not be dislodged during wiring or assembly of electrical connector 10.

Preferably, electrical connector housing 20 has an interlocking arrangement which is similar to that disclosed in U.S. Pat. No. 4,010,999. Specifically, open ends 40 of each of the cover halves 22 and 24 are provided with flanges or locking tabs 70 which are received in the locking grooves or recesses 72 formed in the inside surface of front cover face 26. Also, the back panel of each of the cover halves 22 and 24 has a locking recess 74 for receiving a locking tab or protrusion 76 formed on opposite sides of contact retainer body 28. This interengagement of the locking tabs or flanges and grooves or recesses provides a lateral stress protection for the web hinges 34. Moreover, the web hinges 34 are also protected from longitudinal stresses by the mating of the locking tabs with the associated recesses. While a particular arrangement of locking tabs and locking recesses is illustrated, it will be apparent to those skilled in the art from this disclosure that other arrangements of locking tabs and locking recesses can be utilized as needed and/or desired.

Assembly of Electrical Cord Connector 10 of FIGS. 1–10

Electrical cord connector 10 is assembled by first installing contacts 16 into longitudinal cavities 60 of contact retainer body 28 such that their blade portions extend outwardly from front cover face 26 via openings formed therein. In this position, terminal screws 18 are aligned within access openings 62 of contact retainer body 28.

Next, internal cap 30 is coupled to contact retainer body 28 via screw 58 or via a snap-fit (not shown). In this position, cap 30 covers the openings of contact cavities, 60 with wire openings 52 of cap 30 in communication with contact cavities 60 of contact retainer body 28. Contacts 16 are restrained from moving within contact cavities 60 since the inner ends of contacts 16 are sized to abut against internal cap 30 and front cover face 26.

Now, conductors 14 are connected to terminal screws 18 of contacts 16. In particular, the stripped free ends of electrical conductors 14 are inserted through wire openings 52 and into their respective contact cavities 60 such that the stripped ends of the electrical conductors 14 engage terminal screws 18 of contacts 16. Then, terminal screws 18 are tightened down so that the stripped ends of electrical conductors 14 are electrically and fixedly coupled to contacts 16 in a conventional manner.

After electrical conductors 14 are coupled to contacts 16, one of the housing halves 22 or 24 is pivoted to form a 90° angle with front cover face 26. In this position, the end of electrical cord 12 is resting on the clamping member 32 of the pivoted cover half. The installer then pivots the other cover half 22 or 24 so that its clamping member 32 engages electrical cord 12. In this position, retaining members 48 abut against cap 30 such that cap 30 is sandwiched in between retaining members 48 and the inner free end of contact retainer body 28 to prevent any movement of internal cap 30. Also, substantially simultaneously, gripping members 50 and 54 now engage conductors 14 and clamping members 32 now engage cord 12.

Finally, screws 36 are threaded into cover half 24 to secure cover halves 22 and 24 together, and thus, substantially simultaneously causing clamping members 32 to tightly grip cord 12 and gripping members 50 to tightly squeeze conductors 14 against complementary gripping member 54 of internal cap 30.

Figure 9:
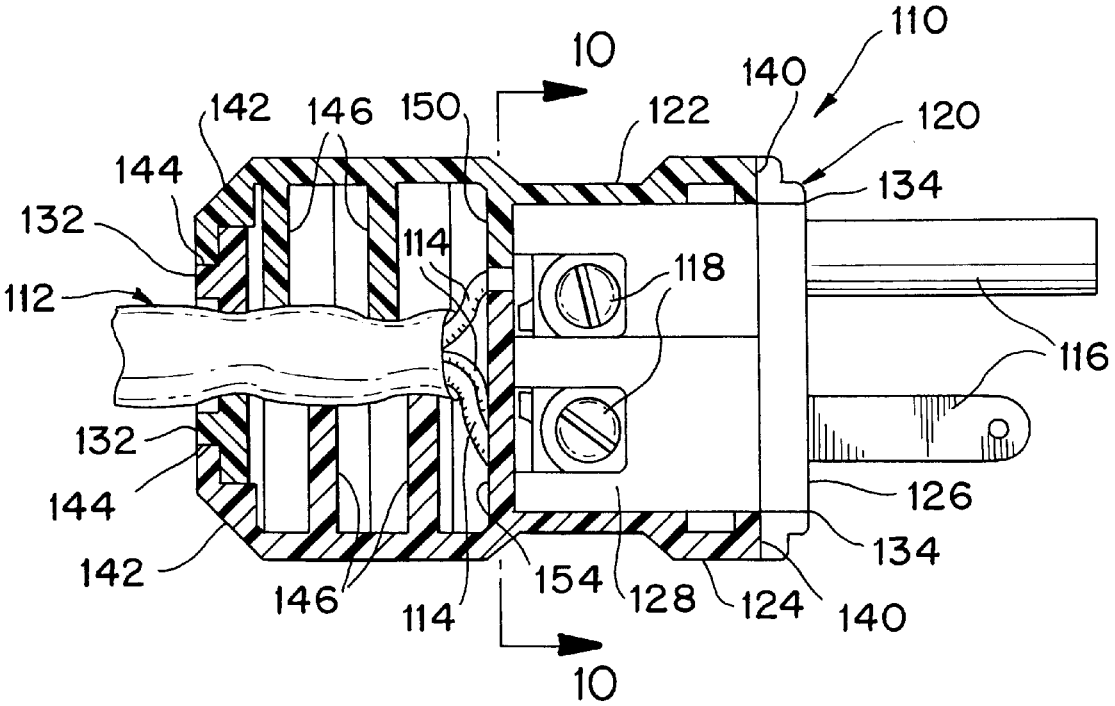
FIG. 9 is a longitudinal cross-sectional view, similar to FIG. 8, of an electrical connector in accordance with a second embodiment of the present invention, with the housing fully closed so that the gripping members restrain the electrical conductors of the electrical cord relative to the terminals located in the contact retainer body.
Figure 10:
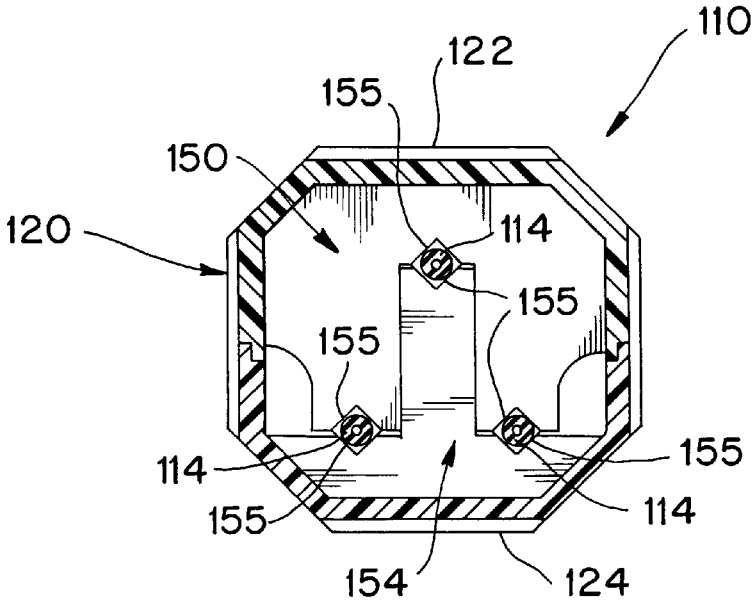
FIG. 10 is a transverse cross-sectional view of the electrical connector illustrated in FIG. 9 in accordance with the second embodiment of the present invention as seen along section line 10—10 of FIG. 9.

Electrical Wiring Device or Connector 110 of FIGS. 9–10

Referring now to FIGS. 9 and 10, an electrical wiring device or cord connector 110 with a strain relief arrangement is illustrated in accordance with a second embodiment of the present invention. More specifically, electrical connector 110 is attached to one end of an electrical cord 112 such that during assembly thereof, the strain relief arrangement of electrical connector 110 will engage both electrical cord 112 and its electrical conductors 114.

Electrical connector 1 10 is basically a modified version of electrical connector 10. In particular, electrical connector 1 10 has been modified to eliminate the use of an internal cap by utilizing complementary gripping members or abutments 150 and 154 which are integrally formed with cover halves 122 and 124, respectively. Since many of the features of electrical connectors 10 and 110 are common in each of the embodiments, the common features of electrical connectors 10 and 1 10 will not be discussed in detail when referring to this second embodiment.

As in the prior embodiments, electrical cord 112 is a conventional electrical cord, and thus, will not be discussed in detail. By way of example, electrical cord 112, as seen in the drawings, preferably has three electrical conductors 114 with each having a conducting core and an insulating sheath thereon. The ends of the electrical conductors 114 are stripped for attaching to terminal screws 118 of contacts 116 (only two shown in the drawings of this embodiment). Contacts 116 are similar to contacts 16 discussed above. By way of example, contacts 116 are installed into longitudinal cavities in the contact body retainer 128 such that their blade portions extend outwardly from front cover face 126 via opening formed therein. In this position, terminal screws 118 of contacts 116 are aligned with an access opening in the contact retainer body 128. While three conductors 114 are illustrated, it will be apparent to those skilled in the art that the present invention can be utilized with an electrical cord with two electrical conductors or with an electrical cord more than three electrical conductors. Of course, housing 120 would have to be modified to accommodate the additional conductor or conductors.

Basically, electrical connector 110 has a housing 120 with a first cover half 122, a second cover half 124, a front cover face 126 and a contact retainer body, or portion 128. Cover halves 122 and 124 of connector housing 120 are held in their assembled position by a pair of screws (not shown). Of course, other types of fastening members can be used to hold cover halves 122 and 124 together. Electrical connector 110 also optionally has a cord clamp removably coupled to housing 120. The cord clamp includes a pair of clamping members 132 which are designed to provide strain relief for the end of electrical cord 112 which is coupled to electrical connector 110. Cover halves 122 and 124 are also provided with integral gripping members or abutments 150 and 154, respectively for engaging and gripping the individual conductors 114 to provide additional strain relief for the connections of conductors 114 to terminal screws 118.

Preferably, first cover half 122, second cover half 124, front cover face 126, contact retainer body 128, and gripping members 150 and 154 are integrally formed is a one-piece, integral unit of a suitable insulating material such as nylon. More specifically, first cover half 122 and second cover half 124 are hinged to front cover face 126 by web hinges 134, while contact retainer body 128 is integrally formed with front cover face 126 and extends from the interior surface of front cover face 126 between cover halves 122 and 124.

Cover halves 122 and 124 are substantially identical for purposes of discussion of this invention and similar to the first embodiment. Of course, as seen in the Figures, there are some minor differences between cover halves 122 and 124 for mating of cover halves 122 and 124 together during assembly thereof. Accordingly, like reference numerals will be utilized to discuss the parts which are common between cover halves 122 and 124.

Cover halves 122 and 124 form a cord receiving cavity 138 for receiving cord clamps 132, electrical cord 112 and contact retainer body 128 therein. More specifically, each of the cover halves 122 and 124 have an open end 140 coupled to front cover face 126 by web hinges 134, and a closed end 142 with a semi-circular cord opening 144. Each of the cover halves 122 and 124 further includes a pair of ribs 146 adjacent cord opening 144 for clamping electrical cord 112 when cord clamping members 132 are not utilized.

Each of the gripping members 150 and 154 has three V-shaped notches 155 for receiving and squeezing conductors 114 therein. Gripping members 150 and 154, preferably, abut against the internal ends of contacts 116 to prevent longitudinal movement of contacts 116 within housing 120. In other words, gripping members 150 and 154 essentially perform two functions. First, gripping members 150 and 154 provide strain relief for the individual conductors 114 such that conductors 114 do not become detached from contacts 116 when a force is applied to cord 112. Second, gripping members 150 and 154 act as restraining members for preventing movement of contacts 116 within housing 120.

Figure 11:
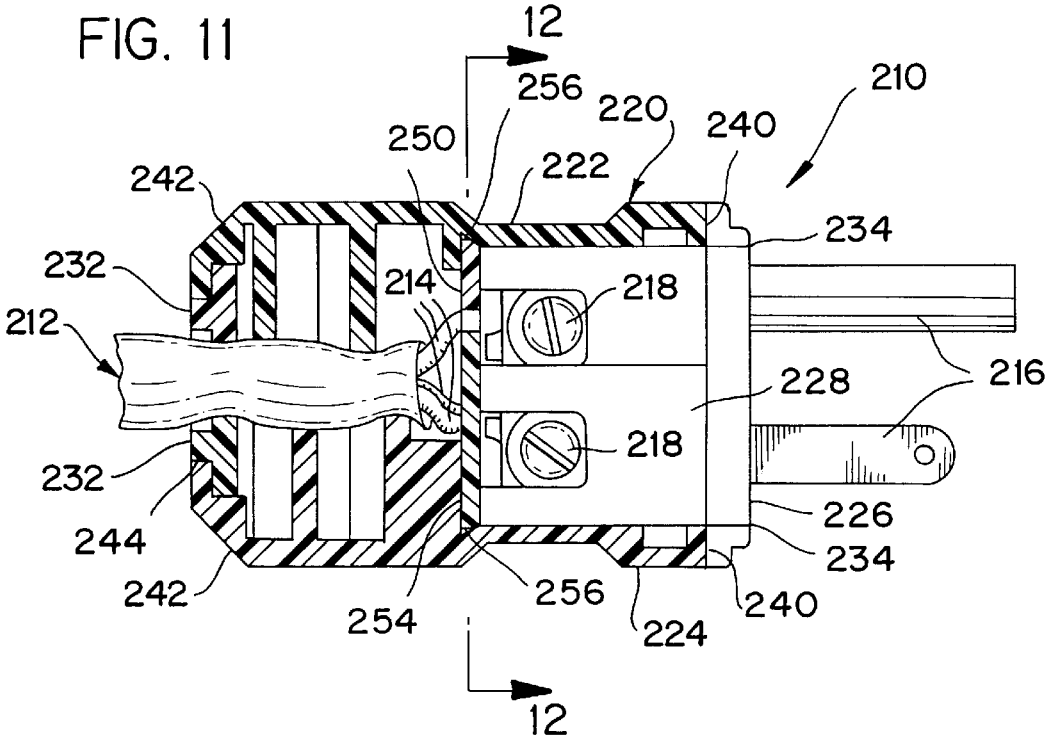
FIG. 11 is a longitudinal cross-sectional view, similar to FIGS. 8 and 9, of an electrical connector in accordance with a third embodiment of the present invention, with the housing fully closed so that the gripping members restrain the electrical conductors of the electrical cord relative to the terminals located in the contact retainer body.
Figure 12:
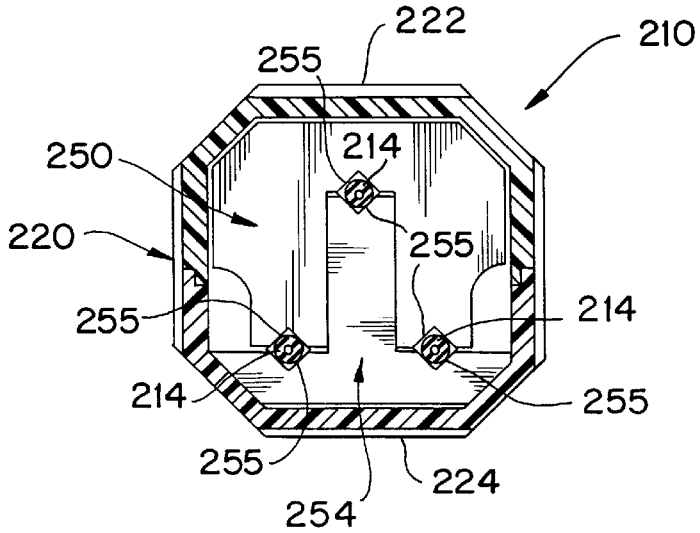
FIG. 12 is a transverse cross-sectional view of the electrical connector illustrated in FIG. 11 in accordance with the third embodiment of the present invention as seen along section line 12—12 of FIG. 11.

Electrical Wiring Device or Connector 210 of FIGS. 11–12

Referring now to FIGS. 11 and 12, an electrical wiring device or cord connector 210 with a strain relief arrangement is illustrated in accordance with a third embodiment of the present invention. In particular, electrical connector 210 is attached to one end of an electrical cord 212 such that during assembly thereof, the strain relief arrangement of electrical connector 210 will engage both electrical cord 212 and electrical conductors 214. Basically, electrical conductor 210 is identical in construction to electrical connector 110, as discussed above, except that gripping members 250 and 254 are removable inserts which are frictionally retained in recesses 256 of housing 220.

In view of the similarities between this embodiment and the prior embodiments, electrical connector 210 will only be briefly discussed herein. It will be apparent to those skilled in the art that the description of the preceding embodiments applies to this embodiment for similar features.

Basically, electrical connector 210 has a housing 220 with a first cover half 222, a second cover half 224, a front cover face 226 and a contact retainer body 228. Electrical connector 210 also has a cord clamp movably coupled within housing 220. The cord clamp includes a pair of clamping members 232 which are designed to provide strain relief for an electrical cord 212 coupled to electrical connector 210.

Cover halves 222 and 224 are substantially identical for purposes of discussion of this invention. Of course, as seen in the Figures, there are some minor differences between cover halves 222 and 224 for mating of cover halves 222 and 224 together during assembly thereof. Accordingly, like reference numerals will be utilized to discuss the parts which are common between cover halves 222 and 224.

Each of the gripping members 250 and 252 are provided with three V-shaped notches 155 for receiving and squeezing conductors 214 therein. Gripping members 250 and 254, preferably, abut against the internal ends of contacts 216 to prevent longitudinal movement of contacts 216 within housing 220. In other words, gripping members 250 and 254 essentially perform two functions. First, gripping members 250 and 254 provide strain relief for the individual conductors 214 such that conductors 214 do not become detached from contacts 216 when a force is applied to cord 212. Second, gripping members 250 and 254 act as restraining members for preventing movement of contacts 216. While gripping members 250 and 254 are illustrated as being vertically aligned, it will be apparent to those skilled in the art from this disclosure that gripping members 250 and 254 can be offset such that conductors 214 are bent.

Electrical Wiring Device or Connector 10' of FIGS. 13–14

Referring to FIGS. 13 and 14, an electrical wiring device or cord connector 10' with a strain relief arrangement is illustrated in accordance with a fourth embodiment of the present invention. Electrical connector 10' illustrates a female electrical connector which utilizes the strain relief arrangement illustrated and described in either the first, second or third embodiments of the present invention. In other words, the only significant differences between electrical connector 10' of this embodiment and the electrical connectors 10, 110 and 210 of the prior embodiments are that the housing and contacts of electrical connector 10' have been modified to accommodate female blade contacts. Therefore, electrical connector 10' will not be discussed or illustrated in detail herein. Moreover, the same reference numerals of the first embodiment will be utilized with this fourth embodiment to indicate similar parts, except that a prime (') will be utilized with the reference numerals of this embodiment.

Basically, electrical connector 10' has a housing 20' with a pair of cover halves 22' and 24' which are hingedly coupled to front cover face 26'. Front cover face 26' has contact openings 16' for receiving the male contacts of a mating electrical connector therein as seen in FIG. 14. As in prior embodiments, a pair of clamping members 32' are used to provide strain relief between electrical cord 12' and housing 20'. Of course, gripping members (not shown) are also provided within housing 20' to grip individual conductors 14'. These gripping members can be formed in accordance with the first, second or third embodiments discussed above. Thus, the gripping members of electrical connector 10' will not be discussed or illustrated in detail herein.

While various embodiments have been chosen to illustrate the invention, it will be understood by those skilled in the art that various changes and modifications can be made herein without departing from the scope of the invention as defined in the appended claims.

What is claimed is:

1. An electrical connector adapted to be coupled to an end of an electrical cord with a plurality of electrical conductors, comprising:

a contact retainer portion having at least two blade contacts with at least two terminals therein, a front end adapted to mate with a mating electrical wiring device, and an inner end adapted to receive the electrical conductors of the electrical cord;

a first cover portion having a first end coupled to said contact retainer portion, a second end spaced from said first end, and a first cavity formed between said first and second ends;

a second cover portion having a first end coupled to said contact retainer portion, a second end spaced from said first end of said second cover portion, and a second cavity formed between said first and second ends of said second cover portion;

a first gripping member coupled to at least one of said first and second cover portions adjacent said inner end of said contact retainer portion to engage and grip the electrical conductors of the electrical cord; and a second gripping member coupled to at least one of said first and second cover portions adjacent said inner end of said contact retainer portion to engage and grip the electrical conductors of the electrical cord between said first and second gripping members.

2. An electrical connector according to claim 1, wherein said second gripping member includes abutments coupled to an internal cap which is in turn coupled to said contact retainer portion, said internal cap has at least two conductor holes for receiving the electrical conductors therethrough with said abutments located adjacent said conductor holes.

3. An electrical connector according to claim 2, wherein each of said abutments of said internal cap has a semi-circular surface partially surrounding at least one of said conductor holes of said internal cap.

4. An electrical connector according to claim 2, wherein said first gripping member has abutments coupled to at least one of said cover portions.

5. An electrical connector according to claim 4, wherein said abutments of said first gripping member are integrally coupled to at least one of said cover portions.

6. An electrical connector according to claim 4, wherein said internal cap has three conductor openings extending therethrough.

7. An electrical connector according to claim 3, wherein said semi-circular surfaces of said abutments has ridges.

8. An electrical connector according to claim 4, wherein said first ends of said cover portions are movably coupled to said front end of said contact retainer portion by a pair of integral hinges.

9. An electrical connector according to claim 8, wherein said cover and contact retainer portions include a locking tab and a locking recess arrangement formed adjacent said first ends of said cover portions and said front end of said contact retainer portion.

10. An electrical connector according to claim 4, wherein said blade contacts are female contacts which are positioned completely within said contact retainer portion, and said front end of said contact retainer portion has openings which allow a mating connector to electrically engage said blade contacts.

11. An electrical connector according to claim 4, wherein said blade contacts are male contacts which at least partially extend outwardly from said front end of said contact retainer portion.

12. An electrical connector according to claim 4, further comprising a pair of cord clamps coupled to said first and second cover portions adjacent said second ends of said first and second cover portions.

13. An electrical connector according to claim 12, wherein said cord clamps are removably coupled to said first and second cover portions.

14. An electrical connector according to claim 13, wherein said first and second gripping members are substantially aligned with each other when said cover portions are in their closed positions.

15. An electrical connector according to claim 1, wherein said first and second gripping members are removably coupled to said first and second cover portions.

16. An electrical connector according to claim 15, wherein said first and second gripping members are frictionally retained in recesses formed in said first and second cover portions, respectively.

17. An electrical connector according to claim 16, wherein at least three of said contact cavities are formed in said contact retainer portion with one of said blade contacts located in each of said contact cavities.

18. An electrical connector according to claim 17, wherein said blade contact abuts against at least one of said first and second gripping members.

19. An electrical connector according to claim 15, wherein said first ends of said cover portions are movably coupled to said front end of said contact retainer portion by a pair of integral hinges.

20. An electrical connector according to claim 19, wherein said cover and contact retainer portions include a locking tab and a locking recess arrangement formed adjacent said first ends of said cover portions and said front end of said contact retainer portion.

21. An electrical connector according to claim 15, wherein said blade contacts are female contacts which are positioned completely within said contact retainer portion, and said front end of said contact retainer portion has openings which allow a mating connector to electrical engage said blade contacts.

22. An electrical connector according to claim 15, wherein said blade contacts are male contacts which at least partially extend outwardly from said front end of said contact retainer portion.

23. An electrical connector according to claim 15, further comprising a pair of cord clamps coupled to said first and second cover portions adjacent said second ends of said first and second cover portions.

24. An electrical connector according to claim 23, wherein said cord clamps are removably coupled to said first and second cover portions.

25. An electrical connector according to claim 15, wherein said first and second gripping members are substantially aligned with each other.

26. An electrical connector according to claim 15, wherein said second gripping member includes abutments coupled to an internal cap which is in turn coupled to said contact retainer portion, said internal cap has at least two conductor holes for receiving the electrical conductors therethrough with said abutments located adjacent said conductor holes, each of said abutments of said internal cap has a semi-circular surface partially surrounding at least one of said conductor holes of said internal cap.

27. An electrical connector according to claim 1, wherein said first and second gripping members are integrally coupled to said first and second cover portions.

28. An electrical connector according to claim 27, wherein at least three of said contact cavities are formed in said contact retainer portion with one of said blade contacts located in each of said contact cavities.

29. An electrical connector according to claim 27, wherein said blade contact abuts against at least one of said first and second gripping members.

30. An electrical connector according to claim 27, wherein said first ends of said cover portions are movably coupled to said front end of said contact retainer portion by a pair of integral hinges.

31. An electrical connector according to claim 30, wherein said cover and contact retainer portions include a locking tab and a locking recess arrangement formed adjacent said first ends of said cover portions and said front end of said contact retainer portion.

32. An electrical connector according to claim 27, wherein said blade contacts are female contacts which are positioned completely within said contact retainer portion, and said front end of said contact retainer portion has openings which allow a mating connector to electrical engage said blade contacts.

33. An electrical connector according to claim 27, wherein said blade contacts are male contacts which at least partially extend outwardly from said front end of said contact retainer portion.

34. An electrical connector according to claim 27, further comprising a pair of cord clamps coupled to said cover portions adjacent said second ends of said first and second cover portions.

35. An electrical connector according to claim 27, wherein said first and second gripping members are substantially aligned with each other.

36. An electrical connector adapted to be coupled to an end of an electrical cord with a plurality of electrical conductors, comprising:

a contact retainer portion having a front end adapted to mate with a mating electrical wiring device, an inner end adapted to receive the electrical conductors of the electrical cord and at least two contact cavities extending between said front and inner ends with a blade contact in each of said contact cavities;

a first cover portion having a first end coupled to said contact retainer portion, a second end spaced from said first end, and a first cavity formed between said first and second ends;

a second cover portion having a first end coupled to said contact retainer portion, a second end spaced from said first end of said second cover portion, and a second cavity formed between said first and second ends of said second cover portion;

a pair of abutment members coupled to said inner end of said contact retainer portion with said abutment members having a semi-circular surface positioned adjacent each of said contact cavities to engage and grip the electrical conductors of the electrical cord; and projections coupled to at least one of said first and second portions to engage and grip the electrical conductors of the electrical cord against said semi-circular surfaces of said abutment members.

37. An electrical connector according to claim 36, wherein said abutment members are coupled to an internal cap which is in turn removably coupled to said contact retainer portion, said internal cap has at least two conductor holes for receiving the electrical conductors therethrough with said abutment members being located adjacent said conductor holes.

38. An electrical connector according to claim 36, wherein said projections are integrally coupled to at least one of said cover portions.

39. An electrical connector according to claim 37, wherein said first ends of said cover portions are movably coupled to said front end of said contact retainer portion by a pair of integral hinges.

40. An electrical connector according to claim 39, wherein said cover and contact retainer portions include a locking tab and a locking recess arrangement formed adjacent said first ends of said cover portions and said front end of said contact retainer portion.

41. An electrical connector according to claim 36, further comprising a pair of cord clamps coupled to said first and second cover portions adjacent said second ends of said first and second cover portions.

42. An electrical connector according to claim 41, wherein said cord clamps are removably coupled to said first and second cover portions.

43. An electrical connector according to claim 36, wherein each said blade contact abuts against at least one of said first and second gripping members.

44. An electrical connector according to claim 43, wherein said first ends of said cover portions are movably coupled to said front end of said contact retainer portion by a pair of integral hinges.

45. An electrical connector according to claim 42, wherein said cover and contact retainer portions include a locking tab and a locking recess arrangement formed adjacent said first ends of said cover portions and said front end of said contact retainer portion.

46. An electrical connector according to claim 36, wherein said semi-circular surfaces of said abutments has ridges.

47. An electrical connector adapted to be coupled to an end of an electrical cord with a plurality of electrical conductors, comprising:

a contact retainer portion having at least two blade contacts with at least two terminals therein, a front end adapted to mate with a mating electrical wiring device, and an inner end adapted to receive the electrical conductors of the electrical cord;

a first cover portion having a first end coupled to said contact retainer portion, a second end spaced from said first end, and a first cavity formed between said first and second ends;

a second cover portion having a first end coupled to said contact retainer portion, a second end spaced from said first end of said second cover portion, and a second cavity formed between said first and second ends of said second cover portion;

gripping means, located adjacent said inner end of said contact retainer portion, for individually engaging and gripping the electrical conductors of the electrical cord.

48. An electrical connector adapted to be coupled to an end of an electrical cord having a plurality of insulated electrical conductors therein, the combination comprising:

first and second covers having electrical terminals coupled thereto, and having a first set of cord gripping members and a plurality of a second set of conductor gripping members coupled thereto;

means, coupled to said electrical terminals, for electrically connecting the insulated electrical conductors thereto; and means, coupled to said first and second covers, for rigidly coupling said first and second covers together, and for frictionally engaging the electrical cord between said first set of cord gripping members, and for frictionally engaging each of the plurality of insulated electrical conductors between one of said second set of conductor gripping members.

49. An electrical connector according to claim 48, wherein said first and second covers form a housing having a longitudinal axis, a first end, and a second end, and said first set of cord gripping members are adjacent said second end, and said plurality of a second set of conductor gripping members are located between said first and second ends.

50. A method of connecting an electrical cord having a plurality of insulated electrical conductors therein to an electrical connector, comprising the steps of placing an end of the cord with the plurality of insulated electrical conductors extending therefrom between first and second parts of the electrical connector, electrically connecting the electrical conductors to terminals carried by the first and second parts of the electrical connector, moving the first and second parts of the electrical connector towards one another and substantially simultaneously frictionally gripping both the electrical cord and the plurality of electrical conductors between the first and second parts of the electrical connector to provide strain relief to the cord and to the conductors, and rigidly coupling the first and second parts of the electrical connector together.

51. A method of connecting an electrical cord according to claim 50, wherein the step of frictionally gripping the electrical cord takes place adjacent one end of the electrical connector, and the step of frictionally gripping the electrical conductors takes place between the opposite ends of the electrical connector.

* * * * *